US010926974B2

(12) United States Patent
Knecht et al.

(10) Patent No.: US 10,926,974 B2
(45) Date of Patent: Feb. 23, 2021

(54) METHOD AND APPARATUS FOR CONTROLLING AN ELEVATOR SYSTEM

(71) Applicant: Inventio AG, Hergiswil (CH)

(72) Inventors: Adrian Knecht, Döttingen (CH); Astrid Sonnenmoser, Hochdorf (CH); Ivo Lustenberger, Buttisholz (CH); Kurt Heinz, Buchs (CH); Martin Hess, Baar (CH); Thomas Hartmann, Kleinwangen (CH)

(73) Assignee: INVENTIO AG, Hergiswil (CH)

( * ) Notice: Subject to any disclaimer, the term of this patent is extended or adjusted under 35 U.S.C. 154(b) by 502 days.

(21) Appl. No.: 15/764,404

(22) PCT Filed: Sep. 26, 2016

(86) PCT No.: PCT/EP2016/073220

§ 371 (c)(1),
(2) Date: Mar. 29, 2018

(87) PCT Pub. No.: WO2017/055420

PCT Pub. Date: Apr. 6, 2017

(65) Prior Publication Data

US 2018/0215579 A1 Aug. 2, 2018

(30) Foreign Application Priority Data

Sep. 30, 2015 (EP) ..... 15187785

(51) Int. Cl.
*B66B 5/00* (2006.01)
*B66B 13/22* (2006.01)

(52) U.S. Cl.
CPC ..... *B66B 5/0031* (2013.01); *B66B 5/005* (2013.01); *B66B 13/22* (2013.01)

(58) Field of Classification Search
CPC ..... B66B 5/0031; B66B 5/005; B66B 13/22
See application file for complete search history.

(56) References Cited

U.S. PATENT DOCUMENTS 6,193,019 B1 * 2/2001 Sirigu ..... B66B 13/22 187/391
7,849,975 B2 * 12/2010 Ketonen ..... B66B 13/22 187/394

(Continued)

FOREIGN PATENT DOCUMENTS

EP 1404603 B1 4/2004
EP 1638880 B2 3/2006

(Continued)

*Primary Examiner* — Jeffrey Donels
(74) *Attorney, Agent, or Firm* — William J. Clemens; Shumaker, Loop & Kendrick, LLP

(57) ABSTRACT

An elevator system drive unit moves an elevator car in an elevator shaft to at least two shaft access doors under control of a control unit. The car does not move or moves only to a limited extent if an individual is in the shaft. A monitoring unit and sensor (switching contact) detect changes in state in at least one of the doors using a sequence of pulses monitoring signal. The monitoring unit has a battery and can be switched to an autonomous mode when the elevator system is entirely or partially disabled. The monitoring unit, in the autonomous mode, records state data from the sensor and is connected to a safeguard unit that reads and evaluates the recorded state data, and prevents the elevator system from being put into the normal mode of operation if a change in the state of one of the monitored doors has been detected.

15 Claims, 10 Drawing Sheets

(56) References Cited

U.S. PATENT DOCUMENTS

| | | | | |
|---|---|---|---|---|
| 2015/0166303 | A1* | 6/2015 | Puranen | H04B 10/25 187/277 |
| 2015/0307326 | A1* | 10/2015 | Lustenberger | B66B 1/28 187/393 |
| 2015/0377968 | A1* | 12/2015 | Lustenberger | B66B 13/22 324/415 |
| 2018/0354747 | A1* | 12/2018 | Sonnenmoser | B66B 5/005 |

FOREIGN PATENT DOCUMENTS

| | | | |
|---|---|---|---|
| WO | 03008316 | A1 | 1/2003 |
| WO | 2005000727 | A1 | 6/2005 |
| WO | 2013020806 | A1 | 2/2013 |
| WO | 2013045271 | A1 | 4/2013 |
| WO | 2014124779 | A1 | 8/2014 |
| WO | 2014124780 | A1 | 8/2014 |

* cited by examiner $s_{TX1}$
$s_{TX2}$
$s_{RX2}$
T
n
$s_{TX}$
$s_{RX}$
op
ip
11A
31A
18
10A
12
13
14
15
150 CPU
151 REG
152 RAM
BP
FP
153 DAC
154 P1
155 I/O
156 WD
157 T1
158 ADC
159 P2
1
2
154 OUTPUT MODULE 156, 157 TIMERS 159 INPUT MODULE

METHOD AND APPARATUS FOR CONTROLLING AN ELEVATOR SYSTEM

FIELD

The invention relates to a method and apparatus for safe controlling of an elevator system.

BACKGROUND

An elevator system usually comprises an elevator car, an elevator shaft in which the elevator car moves, and a drive unit for moving the elevator car.

WO2005/000727A1 indicates that elevator systems include a safety circuit, with which a plurality of safety elements, such as safety contacts and switches are arranged in a series circuit. The contacts monitor, for example, whether a shaft door or car door is open. The elevator car can only be moved when the safety circuit and thus also all of the safety contacts integrated therein are closed. Some of the safety elements are actuated by the doors. Other safety elements, such as a drive-over switch, are actuated or triggered by the elevator car. The safety circuit is connected to the drive or the brake unit of an elevator system in order to interrupt the travel operation if the safety circuit is opened.

WO2005/000727A1 also discloses elevator systems which are provided, instead of the above-mentioned safety circuit, with a safety bus system that typically comprises a control unit, a safety bus, and one or more bus nodes.

Not only the safety of individuals transported by the elevator system is important, but so too is the safety of individuals who are in the elevator shaft, for example, for maintenance purposes.

WO2003008316A1 indicates that today's elevator systems are, for safety reasons, designed so that a protective space is provided in the form of a shaft pit at the bottom of the shaft in order to ensure that maintenance personnel in the shaft are not endangered when the elevator car moves to the lowermost position in the shaft.

In addition, at the upper end of the shaft—called the shaft head—there is usually a protective space provided so that maintenance personnel performing maintenance on the roof of the car are not endangered when the car moves to the uppermost position in the shaft.

An elevator system having a protective space at the lowermost and uppermost end of the shaft is several meters longer than the actual floor height of the building served by the elevator. This applies to various types of elevator dispositions, such as cable elevators, hydraulic elevators, or linear motor elevators.

To prevent or reduce the size of such protective spaces, the elevator system disclosed in WO2003008316A1 has—in addition to and independent of the usual sensors and control means which are provided for the normal operation of the elevator system—a detection apparatus which detects whether an individual is in a critical zone of the shaft, particularly within the shaft pit or the shaft head. The detection can be carried out by any sensors, such as photoelectric sensors. This detecting apparatus is connected to the drive unit of the elevator system such that the elevator system can be transferred into a special operating mode if an individual is in the critical zone or is about to go thereinto.

The detection apparatus and the special control device are designed in terms of safety to prevent the movement of the elevator car into the critical zone in all circumstances, if an individual is therein. The safety design requires, for example, that there be redundant key components, that key functions of control device run in parallel and the results thereof be compared, and that data be transmitted over parallel lines. The safety design of the elevator system is therefore associated with considerable expenditure.

WO2013/045271A1 describes an apparatus for safely controlling an elevator system. The apparatus comprises two counting apparatuses, by means of which movements of a shaft door can be detected. One counting apparatus is active only when power supply is intact. The other counting apparatus is designed so as to be energy-independent, and is therefore active both when power supply is intact and offline. Based on the count values of the two counting apparatuses, it can be determined whether the shaft door has been opened when power supply was offline. The self-powered counting apparatus comprises a permanent magnet and an induction unit which enable operation of the counting apparatus without the use of a battery.

WO2014/124779A1 also discloses an apparatus for safely controlling an elevator system. The apparatus comprises an interrogation device and a safety switch for monitoring a door lock of a shaft door of the elevator system. The interrogation unit, in a loss of power supply, is powered by an independent power supply device, for example, in the form of a battery.

SUMMARY

The present invention therefore addresses the problem of overcoming the drawbacks of the prior art and setting forth an improved method and improved apparatus for safe control of an elevator system.

The method and apparatus according to the invention are to allow for implementation or operation, in particular, with the least possible maintenance expenditure by a service technician.

In particular, in the event of a power failure, the method and apparatus according to the invention are to enable long-running monitoring of the elevator system so that the elevator system can be restarted automatically after the end of a prolonged power failure or plurality of successive power failures, and so that an inspection of the elevator system by the maintenance personnel is not required. Moreover, inspection and maintenance of the apparatus are to be necessary only as seldom as possible.

The method and the apparatus are used for safe control of an elevator system comprising a drive unit which allows an elevator car located in an elevator shaft (35) to move and which is controlled in a safe manner by a control device such that a) in the normal mode of operation, the elevator car can be moved to at least two accesses to the elevator shaft at which doors controlled by the control device are provided, a door lock being associated with at least one thereof, by means of which door lock the associated door can be unlocked and opened even in the case of a power failure; and b) the elevator car does not move or moves only to a limited extent if an individual is in the elevator shaft.

A monitoring unit and a monitoring sensor that allow changes in state—such as unlocking or opening of the door—to be detected are associated with at least one of the doors. The monitoring unit a) is equipped with a battery and can be switched to an autonomous mode when the elevator system is entirely or partially disabled;

b) is connected to the monitoring sensor and monitors the state of the monitoring sensor and records corresponding state data during the autonomous mode;

c) is connected to a safeguard unit which reads the recorded state data from all of the connected monitoring units, evaluates said state data, and prevents the elevator system from being put into the normal mode of operation if a change in the state of one of the monitored doors has been detected.

The monitoring sensor is a switching contact coupled to the associated door lock, via which a monitoring signal is transmitted from an output to an input of the monitoring unit, which monitors the transmitted monitoring signal with respect to state changes which occur upon actuation of the door lock. The output may also be referred to as a so-called output port and the input as a so-called input port of the monitoring unit. If the switching contact is opened, the transmission of the monitoring signal is interrupted and the opening of the switching contact is detected in the monitoring unit. This signal change or state change is recorded in the monitoring unit. State data can be stored in the monitoring unit and made available for evaluation by the safeguard unit or already evaluated in the monitoring unit, so that the monitoring unit, after the end of the power failure, is already transmitting the result of the monitoring—the presence or absence of an individual in the elevator shaft—to the central safeguard unit.

According to the invention, the monitoring signal is in the form of a sequence of pulses. Transmitting a sequence of pulses requires much less energy than transmitting a continuous direct current or alternating current. The battery thus has a lesser load as compared to the transmission of a continuous direct current or alternating current. It is particularly advantageous if the monitoring signal is transmitted as a sequence of pulses having a relatively large time interval between each other.

Due to the low load on the battery by the pulsed signal monitoring signal, the battery reaches a long service life, which allows for the state of charge thereof to be inspected only rarely and allows for only rare replacement of the battery. This significantly reduces the outlay for testing and maintenance of the monitoring unit.

The monitoring signal is designed, in particular, as a sequence of identical pulses, or as a sequence of different pulses having an established setpoint form. The setpoint forms differ, for example, in the pulse position, the pulse shape, the pulse amplitude, and/or the pulse width.

The invention, which is applicable to various types of elevator dispositions, such as cable elevators, hydraulic elevators, or linear motor elevators, makes it possible to safely monitor an individual's access into the elevator shaft and prevent the transition of the elevator system to the normal mode of operation, if an event has been detected that indicates that an individual may possibly have come into the elevator shaft. Once a critical state change is detected or recognized by the safeguard unit, then this is signaled, for example, to a control computer. Alternatively, the control unit may intervene directly in the elevator system and, for example, interrupt the power supply or remove the drive unit from operation. The safeguard unit may, for example, be integrated as a software module in the control computer, or be formed as a separate module, which interacts with the control computer or other parts of the elevator system. The elements for monitoring and safe control of the elevator system may therefore be integrated with the other elements for controlling the elevator system or implemented independently thereof.

This access by an individual in the elevator shaft is particularly critical especially when the elevator system is switched off together with the conventional safeguard modules, if any are present. In this state, a person can actuate a door lock, for example by means of a tool or key to open the door and enter the elevator shaft, and is exposed to risk of injury if the system is started up. An automatic start-up is therefore avoided for safety reasons. Instead, the maintenance personnel check after a power outage for whether the elevator shaft is free and the elevator system can be started up.

As described above, there may alternatively be provided sensors that detect the presence of an individual in the elevator shaft when the system is started up. Provided that such detection is to be carried out safely, it is thus connected with considerable expenditure. On the one hand, hardware and software are safe to implement. On the other hand, sensors are to be provided so that the individual can be reliably detected at any point of the elevator shaft. The detection should also be ensured if the sensors are dirty or abnormal conditions such as smoke prevail within the elevator shaft.

According to the invention, the problem is solved with relatively simple and very safe measures. According to the invention, an opening of a door or actuation of the door lock is detected. For this purpose, different monitoring sensors or probes can be used, such as motion sensors, pressure sensors, optical sensors, capacitance sensors that detect a mutual displacement of metallic elements of the door, or motors that are operated as a generator in the event of a manual movement of a door. Particularly useful are monitoring sensors that do not require power supply, such as switching elements, which are actuated by an element of the door or lock.

Since, after the shutdown of the elevator system, no power is supplied from the local network, the monitoring unit is equipped with a battery and is designed such as to be automatically switchable into an autonomous mode if the elevator system is shut down. For example, a relay is provided which is activated by electrical current from the grid and connects the circuit of the monitoring unit with an operating voltage. As soon as the mains power supply fails, the relay is deactivated and falls in a sleep mode in which the battery is connected to the circuit of the monitoring units.

The elevator system can therefore by monitored permanently—i.e., during the normal mode of operation as well as after shutdown—by means of the monitoring units, in order to determine whether a door or lock has been actuated. Of primary importance is the monitoring according to the invention of the elevator system during a power outage, because during the normal mode of operation, other means can be used. After the end of the power failure, the monitoring data can be read out from the monitoring units.

For this purpose, each of the monitoring units is connected to at least one monitoring sensor and monitors the state thereof during the autonomous mode and records corresponding state data. In particular, all doors where it can be expected that same could be opened during a power outage in order to enter the elevator shaft are monitored. In particular, thus, there is monitoring of any door with which a door lock by means of which the associated door can be unlocked and opened even in the event of a power failure is associated. To monitor a plurality of doors, a combination of monitoring unit and monitoring sensor can be arranged at each door. Alternatively, it is possible for only one monitoring sensor to be arranged at the individual doors, and a plurality of monitoring sensors to be monitored by one monitoring unit. Only a single battery would also be necessary in this case. The monitoring sensors can be connected, in particular, in series for this purpose. In the event that a monitoring unit monitors a plurality of monitoring sensors, a particularly inexpensive implementation of the method is possible, because a separate monitoring unit with a battery is not necessary for each door.

After the end of the power failure, the state data collected in the monitoring units is read out by the safeguard unit. Preferably, the monitoring units are initially switched from battery operation to the mains operation. After evaluating the data transmitted from the monitoring units, the safeguard unit decides whether perhaps an individual has actuated the elevator doors and entered the elevator shaft, and prevents the transition to the normal mode of operation. A fault message is instead transmitted, preferably automatically, via a wired or wireless transmission channel locally to an output unit, a speaker, and/or a display of the elevator system, or remotely to a maintenance service, which subsequently inspects and restarts the elevator system.

If, however, it has been confirmed that no individual has entered the elevator shaft, then the elevator system is automatically returned to the normal mode of operation. Maintenance personnel are not needed in this case. The elevator system can be automatically returned to the normal mode of operation without delay after the power failure has ended. Equipping the elevator systems with the solution according to the invention thus significantly increases the availability of these elevator systems. Even already-installed elevator systems can be retrofitted with the solution according to the invention.

So-called "false negative" messages—i.e., messages that state that no individual is present in the elevator shaft despite the fact that an individual is indeed present in the elevator shaft—are eliminated. So-called "false positive messages"—i.e., messages that confirm the presence of an individual in the elevator shaft as possible despite the fact that no individual is located in the elevator shaft—are to be expected, in turn, after a door lock has been actuated. However, this situation occurs statistically very rarely after a power failure, e.g., in one of a hundred cases, so the guaranteed safety is achieved with minimal effort. Conversely, 99% of all elevator systems are transferred back to the normal mode of operation after the end of a power failure, thereby ensuring a near-maximum availability without delay, with full guarantee of safety.

In one preferred embodiment, the monitoring unit comprises a first processor-controlled monitoring module that emits the monitoring signal at an output port to the switching contact and receives in turn at an input port.

In another preferred embodiment, the monitoring unit comprises a first processor-controlled monitoring module that emits the monitoring signal at an output port and receives at an input port of a second monitoring module via the switching contact. Physically separating the transmission stage and the reception stage from one another ensures that errors that occur in a monitoring module do not directly affect the other monitoring module. This can ensure especially safe operation of the elevator system.

The two monitoring modules may also be provided with operation software in such a manner as to alternately emit the monitoring signal from the output port thereof to the switching contact/receive same at the input port thereof. The two-way operation makes it possible to fully exploit and test the monitoring modules so as to be able ascertain, in the event of a state change, the place on the transmission path at which a state change or transmission error has been generated. If, for example, transmission is possible in one direction and interrupted in the other direction, then an error in one of the transmission modules can be inferred.

The advantage of the especially safe operation of the elevator system through the use of two processor-controlled monitoring modules is also given if the monitoring signal that is transmitted via the switching contact is configured as a permanent direct current or alternating current signal and thus not as a pulsed signal.

In another preferred embodiment, the monitoring signal emitted from the output port of the first monitoring module is supplied, on the one hand, to a first input port of the second monitoring module via the switching contact, and, on the other hand, directly to a second input port of the second monitoring module. Thus, the actual value of the transmitted monitoring signal is supplied via the switching contact to the second monitoring module, and the setpoint value thereof is supplied directly thereto. Comparing the actual value and the setpoint value makes it already possible to confirm a state change. The monitoring signal supplied to the second input port may also be used to activate the second monitoring module, such as will be described hereinbelow.

In an especially preferred embodiment, the monitoring signal emitted from the output port of the first monitoring module is supplied, on the one hand, to a first input port of the second monitoring module and to an input port of the first monitoring module via the switching contact, and, on the other hand, directly to a second input port of the second monitoring module. This especially advantageous in enabling the first monitoring module to change the monitoring signal in accordance with a state change that has occurred, and to perform a faster and/or more in-depth inspection. This solution is especially advantageous in terms of the operation of the monitoring modules with an idle mode switched on, as shall be described below.

The interval between pulses or the pulse repetition frequency and optionally also the pulse width of the monitoring signal are preferably selected so as to be sufficiently safe for detection of a state change, and so as to simultaneously reduce the monitoring activity and thus energy requirements of the monitoring modules to a minimum.

The pulse width of the transmitted pulses is preferably selected so that the second monitoring module can be moved from the sleep mode to the operating mode by a transmitted pulse, and can detect the arrival of this pulse after reaching the operating mode. In this manner, the monitoring modules can be placed between two pulses in a sleep mode in which essential switching parts are switched off and thus only little energy is required from the battery.

According to the invention, pulses or groups of pulses are transmitted in time intervals within which at least one of the monitoring modules is placed in an energy-saving mode or sleep mode when a first event occurs and in an operating mode or operating state when a second event occurs. The first event is preferably determined by the completion of the process of recording state changes of the transmitted monitoring signal, or by expiration of a timer. The second event is determined by the arrival of a transmitted pulse of the monitoring signal or by expiration of a timer.

The preferably constant intervals between the pulses or between the groups of pulses of the monitoring signal are preferably in the range of 0.15 to 1.5 s, in particular, 0.35. In this range, safe monitoring of the elevator doors can be ensured and, at the same time, the energy requirements can be reduced to a minimum. In consideration of the circumstances given, large time intervals may also be selected in order to save even more energy.

The first and/or second monitoring module each have at least one register for storing state data, in which the number t of the transmitted pulses and the number r of the received pulses are stored. The difference between the stored number t of the transmitted pulses and the stored number r of the received pulses may be formed in one of the monitoring modules during the power failure or in the safeguard unit after the end of the power failure, in order to detect any state change that may have occurred. Furthermore, the absence of expected pulses can also be detected and stored.

The monitoring of the elevator system may be influenced by a variety of factors. Of primary importance is the normal appearance of a state change through actuation of an elevator door. The monitoring signal may furthermore be altered by interference signals, following which incorrect measurement results may occur. Malfunctions may also occur within the monitoring units. In addition, measurement can be affected by insufficient power supply or operating voltage. Preferably, means and measures are provided that make it possible to address preferably all of these influences.

During a power failure, there may be interference signals that are caused, for example, by the startup of emergency generators or by bouncing of switches. Preferably, therefore, the transmitted monitoring signal is filtered, in particular, in order to eliminate high-frequency interferences.

The monitoring module that receives the transmitted monitoring signal therefore preferably implements a filter program that filters the monitoring signal and is preferably configured as a low-pass filter or median filter. With a median filter, it is determined whether an established number of the received pulses within a length of time is greater than half the number of the pulses transmitted. The length of time therefore comes from the established number of pulses multiplied by the cycle duration of the pulse repetition frequency. The cutoff frequency of the filter can be shifted by altering the aforementioned number of pulses and the resulting length of time.

A time delay until when a state change—e.g., the absence of a pulse—is signaled at the output of the filter arises after the state change occurs in accordance with the established number of pulses that are processed in the filter and the resulting length of time. If relatively large intervals between pulses are selected, then delays that are undesirably large may occur. If short intervals between pulses are selected, however, the energy requirement increases.

In order avoid short pulse intervals or a high pulse repetition frequency during the time when no state changes occur and simultaneously avoid undesired delays in the direction of a state change that occurs thereafter, the monitoring signal transmitted via the switching contact to be inspected is returned preferably unfiltered to the first monitoring module. In the first monitoring module, the transmitted pulse sequence is monitored and the pulse repetition frequency is raised as soon as a change in a pulse is detected. Thus, in the event of an irregularity, the monitoring activity is intensified and the length of time within which the established number of pulses is processed in the filter is reduced. The time delay to the point of time at which the filter logs the state change that occurred can therefore be reduced by the factor by which the pulse repetition frequency is at least briefly increased.

Changes in the generation, transmission, receipt, and processing of the transmission signal can be caused not only by interference signals, but also by circuit elements of the monitoring modules that are not functioning properly. To ensure proper monitoring of the switching contact, therefore, it is important to be able to recognize functional errors of the monitoring units.

In order for such errors to be recognized dynamically, the monitoring signal is emitted from the first monitoring module as a sequence of different pulses in a manner corresponding to an established setpoint form, the pulses differing in the pulse position and/or the pulse shape and/or the pulse amplitude and/or the pulse width. The corresponding configuration of the monitoring signal may be predetermined by the safeguard unit or permanently programmed in the first or second monitoring module, or even randomly selected.

The safeguard unit and/or at least one of the monitoring modules subsequently compares the monitoring signal transmitted via the switching contact with the monitoring signal not transmitted via the switching contact, or with a predetermined setpoint form of the transmitted monitoring signal, and records deviations that indicate the existence of a corresponding functional error.

Preferably, the first monitoring module sends pulses with different forms, each in a certain quantity. The second monitoring module then determines whether the pulses arrive in the relevant form and number. The tests may be carried out autonomously by the two monitoring modules during the autonomous mode, or during the normal mode of operation by the safeguard unit.

Proper power supply to the monitoring modules is also especially important. The function of the monitoring units is questionable if the battery no longer delivers the required voltage and energy, for example, after a prolonged power outage. Therefore, during the autonomous mode of the monitoring modules, it is preferably checked whether the voltage sent out from the battery falls under a threshold value, and/or whether a brownout is occurring in one of the monitoring modules, i.e., whether individual circuit parts are failing because of insufficient operating voltage. In an emergency, i.e., loss of operating voltage, the monitoring modules are reset and the state data determined is deleted. The absence of the state data is then interpreted as being an improper state change, and the entry into service of the elevator system is prevented.

Preferably, it is provided that the aforementioned tests can also be carried out during the normal mode of operation. For example, a power failure is periodically simulated for the monitoring units. Preferably, the monitoring units are periodically transferred by the safeguard unit to the battery mode or the autonomous operation state during the normal mode of operation of the elevator system, by performance of at least one of the above-mentioned inspections and tests. For example, the monitoring units are transferred to the battery mode and monitored with respect to the operating voltages or the presence of a brownout. A dynamic inspection of the monitoring modules, in which the monitoring signal or the monitoring pulses are altered and the received monitoring signal is inspected, can furthermore be carried out. The state of the switching contacts may also be inspected. For example, test programs are stored and periodically called, by means of which test programs the registers, timers, converters, and amplifiers are inspected even during the normal mode of operation of the elevator system.

After a power failure has ended or a simulation of a power failure has ended, the safeguard unit reads out the recorded state data from all of the connected monitoring units and the monitoring modules provided therein, and carries out an analysis.

In particular, it is a) checked whether the functionality of all of the connected monitoring units is given; and/or b) checked whether a malfunction has occurred at one of the monitoring units; and/or c) checked whether state changes of the monitoring sensor or the switching contact have occurred; and/or d) determined whether there are deviations in the numbers of the transmitted and received pulses recorded in each of the monitoring units.

If there is a missing functionality of one of the monitoring units, or if a state change has occurred in one of the monitoring units, or if there is a deviation in the numbers of the pulses transmitted in each of the monitoring units, then the elevator system is prevented from being transferred back to the normal mode of operation.

DESCRIPTION OF THE DRAWINGS

The apparatus according to the invention shall be described hereinbelow in preferred embodiments by way of example, with reference to the drawings. In the drawings.

FIG. 3*b* illustrates the monitoring signal $s_{TX}$ from FIG. 3*a*, as a pulse sequence having a duty cycle of 50% before the transmission via the switching contact 11A;

FIG. 3*c* illustrates the monitoring signal $s_{RX}$ from FIG. 3*b* after the transmission via the switching contact 11A, which has opened during the duration of two pulses that were not recorded in the register 161 of the second monitoring module 16;

FIG. 4*b* illustrates the monitoring signal $s_{TX}$ from FIG. 4*a* that is emitted at the output port op of the first monitoring module 15;

FIG. 4*c* illustrates the monitoring signal $s_{RX}$ from FIG. 4*a* arriving at the first input port ip1 of the second monitoring module 16;

FIG. 5*b* illustrates the monitoring signal $s_{TX}$ from FIG. 5, as a pulse sequence having a duty cycle of approximately 7% before the transmission via the switching contact 11A, with an additionally-applied auxiliary pulse $p_{AUX}$, that is additionally emitted from the first monitoring module 15 after an expected pulse of the transmitted monitoring signal $s_{RX}$ fails to appear;

FIG. 5*c* illustrates the monitoring signal $s_{RX}$ from FIG. 5*b* after the transmission via the switching contact 11A, which has been opened after the arrival of a first pulse p;

DETAILED DESCRIPTION

Figure 1:
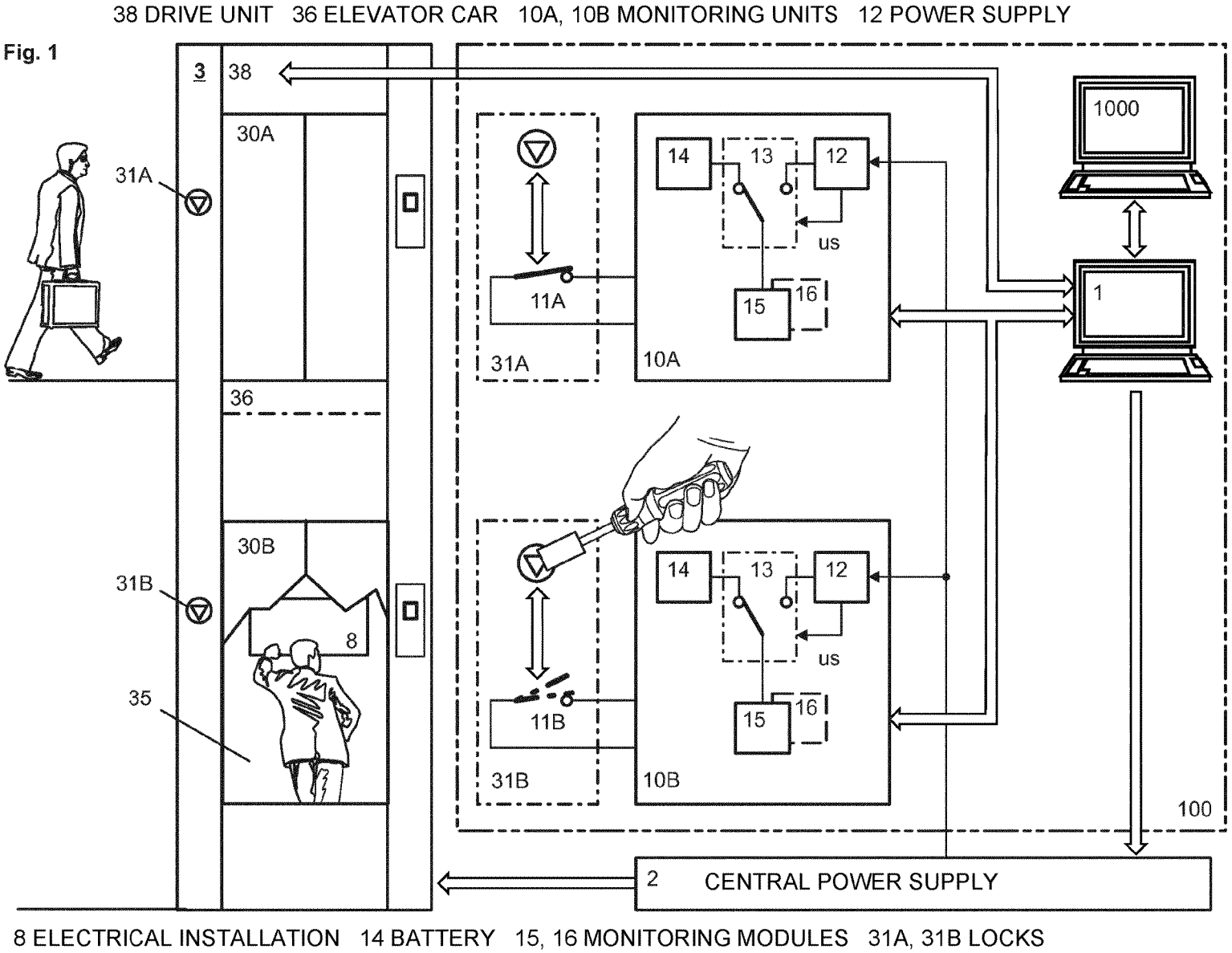
FIG. 1 illustrates an elevator system 3 according to the invention, having a drive unit 38 which allows an elevator car 36 located in an elevator shaft 35 to move between two elevator doors 30A, 30B, and a control device 100 that has, in order to monitor the elevator system 3, a safeguard unit 1 that is connected or can be connected to monitoring units 10A, 10B by means of each of which a lock 31A, 31B of an associated 30A, 30B is monitored.

FIG. 1 illustrates an elevator system 3 according to the invention, with a drive unit 38 that allows an elevator car 36 located in an elevator shaft 35 to move between two elevator doors 30A, 30B. The elevator system 3, which is powered by a central power supply unit 2, is equipped with a control device 100 by means of which the elevator system 3—in particular, the drive unit 38—can be controlled. The control device 100, in order to monitor the elevator system 3, comprises a safeguard unit 1 that is connected or can be connected to monitoring units 10A, 10B, by means of each of which a lock 31A, 31B of an associated elevator door 30A, 30B can be monitored.

The safeguard unit 1, in the present embodiment, is a stand-alone computer system that communicates with a system computer 1000. The safeguard unit 1 may, however, also be integrated into the system computer 1000 as a software module or hardware module. The safeguard unit 1 can, as illustrated in FIG. 1, intervene directly in the elevator system 3 and, for example, control or turn off the power supply 2 or the drive unit 38. Alternatively, the safeguard unit 1 may be connected only to the system computer 1000, which, in turn, executes the safeguarded control of the elevator system 3 by taking into account the state data that has been determined according to the invention.

The safeguard unit 1 and/or the system computer 1000 may additionally be connected to external computer units—e.g., a host computer—wirelessly or via a wired connection.

In the present embodiment, the monitoring sensors 11A, 11B configured as switching contacts that are each mechanically coupled to a door lock 31A, 31B that can be actuated by maintenance personnel by means of a tool, such as is illustrated in FIG. 1 for the switching contact 11B. During a power failure or shut-down of the power supply, the maintenance personnel can thus actuate a door lock 31A, 31B, manually open an elevator door 30A, 30B, and enter the elevator shaft 35.

FIG. 1 shows that after a power failure, the lower elevator door 31B has been opened and a maintenance technician has entered the elevator shaft 35 in order to test an electrical installation 8 that could have caused the power failure. The maintenance technician stands on the shaft bottom in a shaft pit that has only a shallow depth. In this situation, the elevator system 3 must not be operated. In the upper level, a building resident moves to the first elevator door 30A, behind which the elevator car 36 stands. If the power supply to the elevator system 3 is restored in this moment and the normal mode of operation is activated, the building resident can enter and start the elevator car 36. This is prevented by monitoring of the switching contacts 11A, 11B and prevention of the transition into the normal mode of operation if one of the switching contacts 11A, 11B has been actuated. So that this monitoring can be carried out even after a power failure, the monitoring units 10A, 10B are equipped with a battery 14, and can automatically be switched to an autonomous mode if the elevator system 3 has been partially or completely shut down or if there is a power failure.

FIG. 1 shows that the two identically-configured monitoring units 10A, 10B each have a local power supply unit 12 and a battery 14, both of which can be connected to a first and optionally a second monitoring module 15, 16 via a controllable switch unit 13, e.g., a voltage-controlled relay. The switch unit 13 is powered by the power supply unit 12 with a switching voltage us, by which the switch unit 13 is activated and connects the power supply unit 12 to the monitoring modules 15, 16. If there is a power failure, the switching voltage us is dropped and the switch unit 13 falls back to the rest position, in which the battery 14 is connected to the monitoring modules 15, 16.

In each of the monitoring units 10A, 10B, the first monitoring module 15 generates a monitoring signal that is passed via an output of the monitoring unit 10A, 10B and the associated switching contact 11A, 11B back to an input of the monitoring unit 10A, 10B and assessed in the first or second monitoring module 15, 16.

At least during the autonomous mode or during a power failure, therefore, the monitoring sensors or the switching contacts 11A, 11B are monitored in order to record a state change or an actuation of the associated door lock 31A, 31B. Monitoring is preferably also carried out during the normal mode of operation. If actuation of one of the switching contacts 11A, 11B is detected during the normal mode of operation, then the elevator system is preferably switched off.

After the power failure has ended, the elevator system 3 is powered again with energy from the central power supply unit 2. An operating voltage is again supplied to the local power supply units 12 in the monitoring units, which in turn subsequently generate the switching voltage us and activate the switch unit 13. The state data collected in the monitoring units 10A, 10B or status messages already derived therefrom can then subsequently be retrieved by the safeguard unit 1 and further processed. The safeguard unit 1 determines, by consulting the state data from the second monitoring unit 10B, that the associated door lock 31B has been actuated, and that an individual may possibly be present in the elevator shaft 35. The safeguard unit 1 therefore prevents the elevator system 3 from being started up, by direct intervention in the elevator system 3, such as is illustrated in FIG. 1 with the shutdown of the power supply 2 or shutdown of the drive unit 38, or by notification to a higher-level computer or the system computer 1000, which—in turn—prevents the elevator system 3 from being started up.

Instead of providing a separate monitoring unit 10A, 10B for each elevator door 30A, 30B, as in FIG. 1, it would also be possible to provide a single monitoring unit that monitors a plurality of switching contacts each associated with an elevator door. The switching contacts are connected in series in this case, so that the monitoring unit recognizes when one of the two switching contacts is opened. In this case, too, only a single battery is necessary to power the monitoring unit.

The design of the monitoring units 10A, 10B will be described hereinbelow in different preferred embodiments, in which particular importance is given to the safety of the monitoring, the functionality of the monitoring apparatus, and—in particular—the energy savings for discharging the battery 14.

Figures 2A, 2B, 2C, 2D:
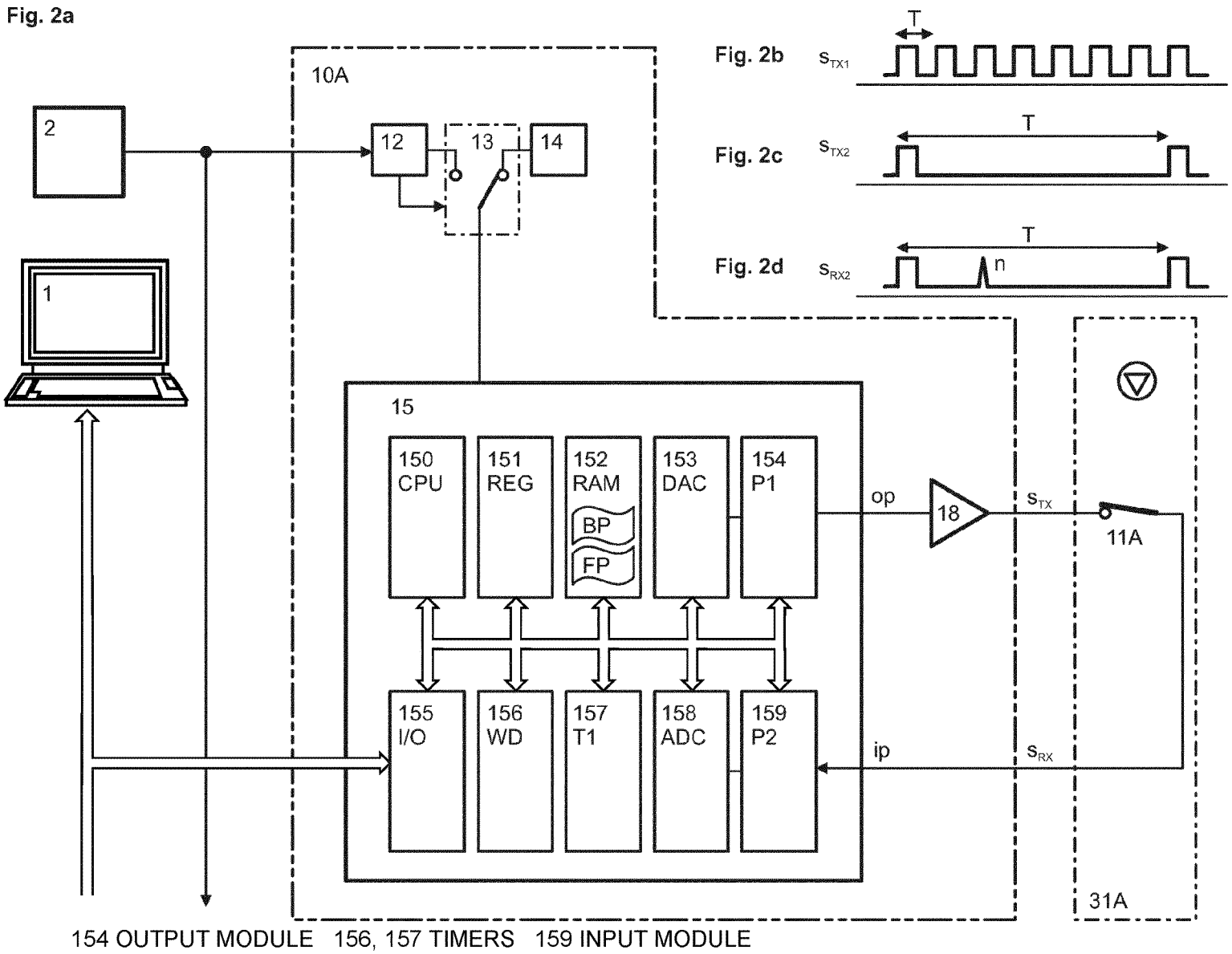
FIG. 2*a* illustrates the first monitoring unit 10A of FIG. 1, which has a processor-controlled monitoring module 15 that transmits a monitoring signal $s_{TX}$ from an output port op via a switching contact 11A that is associated with the door lock 31A of the first elevator door 30A to an input port ip.
FIG. 2*b* illustrates a monitoring signal $s_{TX1}$ emitted at the output port op, as a pulse sequence having a duty cycle of 50%, selected by way of example.
FIG. 2*c* illustrates a monitoring signal $s_{TX2}$ emitted at the output port op as a pulse sequence having a duty cycle of approximately 7% and a cycle duration T increased by a factor of 7.
FIG. 2*d* illustrates the monitoring signal $s_{RX2}$ arriving at the input port ip, into which an interference pulse n has been applied via the switching contact 11A during the transmission.

FIG. 2*a* illustrates the first monitoring unit 10A of FIG. 1, which has only one processor-controlled first monitoring module 15 that transmits a monitoring signal $s_{TX}$ from an output port op via the switching contact 11A—that is associated with the door lock 31A of the first elevator door 30A and mechanically coupled thereto—to an input port ip.

The monitoring module 15 is, for example, a microcontroller having lowest power consumption in the operating mode (preferably <100 μA) and in the sleep mode (preferably <500 nA), short delay times in the transition from the sleep mode to the operating mode (preferably <1 μs), and all of the essential functions for signal processing. For example, a microcontroller is used, such as is described in the documentation "MSP Low-Power Microcontrollers" from Texas Instruments Incorporated, dated 2015.

The monitoring module 15 illustrated in FIG. 2*a* is a microcontroller with a CPU 150, one or more registers 151, a memory 152, an optionally-provided digital/analog converter 153, at least one output module 154, an interface component 155, a watchdog timer 156, at least one other timer T1 157, an analog/digital converter 158, and at least one input module 159. The individual modules are connected or can be connected to one another via a system bus, and to the safeguard unit 1 via the interface component 155.

The second monitoring module 16 from FIG. 1 is preferably configured identically to the first monitoring module 15, but provided with correspondingly adapted software. Preferably, both monitoring modules 15, 16 are provided with test circuits or brownout circuits that make it possible to establish whether the operating voltage—in particular, the voltage of the battery 14—has fallen under a provided value and/or whether individual circuit parts are only insufficiently powered, following which same is recorded accordingly. Preferably, the monitoring module 15 is returned to the output le 15.

An operating program BP and a filter program FP are stored in the memory 152. Via an output port op and an amplifier 18, a monitoring signal $s_{TX}$ that is generated in the monitoring module 15 can be transmitted via the switching contact 11A to an input port ip of the monitoring module 15.

The state of the switch unit 13 indicates that the current has failed and the monitoring module 15 is being supplied with current from the battery 14.

FIG. 2*b* illustrates a monitoring signal $s_{TX1}$ emitted at the output port op, as a pulse sequence having a duty cycle of 50%, by way of example. Comparison of the monitoring signal $s_{TX}$ emitted at the output port op with the monitoring signal $s_{RX}$ received at the input port indicates whether the switching contact 11A has been opened during the transmission. If some of the pulses are not transmitted, then a state change in the switching contact 11A and thus a possible opening of the elevator door 30A is recorded and reported. For example, the number of pulses sent and the number of pulses received are stored in the register 151, and compared against one another before the elevator system 3 is started up, in order to detect a door opening.

FIG. 2*c* illustrates a monitoring signal $s_{TX2}$ from FIG. 2*a*, emitted at the output port op, as a pulse sequence with a duty cycle of approximately 7% and a cycle duration T that is higher by a factor of 7 as compared to the signal from FIG. 2*b*. Reducing the duty cycle and increasing the cycle duration makes it possible to significantly reduce the energy required. Between two pulses, the monitoring module 15 may also be put into a sleep mode in which the power consumption is minimal and only circuit parts that are necessary for the transition from the sleep mode to the operating mode are operated. For example, external stimuli or wake-up signals are monitored. Advantageously, a wake-up signal may also be generated within the monitoring module 15, for example, from a timer 156, 157.

FIG. 2*d* illustrates the monitoring signal $s_{RX2}$ arriving at the input port ip, into which an interference pulse n has been applied via the switching contact 11A during the transmission. Interferences of this type can affect the monitoring and are preferably filtered out. For this purpose, the filter program FP is implemented in the monitoring module 15, as shall be described hereinbelow in a preferred embodiment.

Figure 3A:
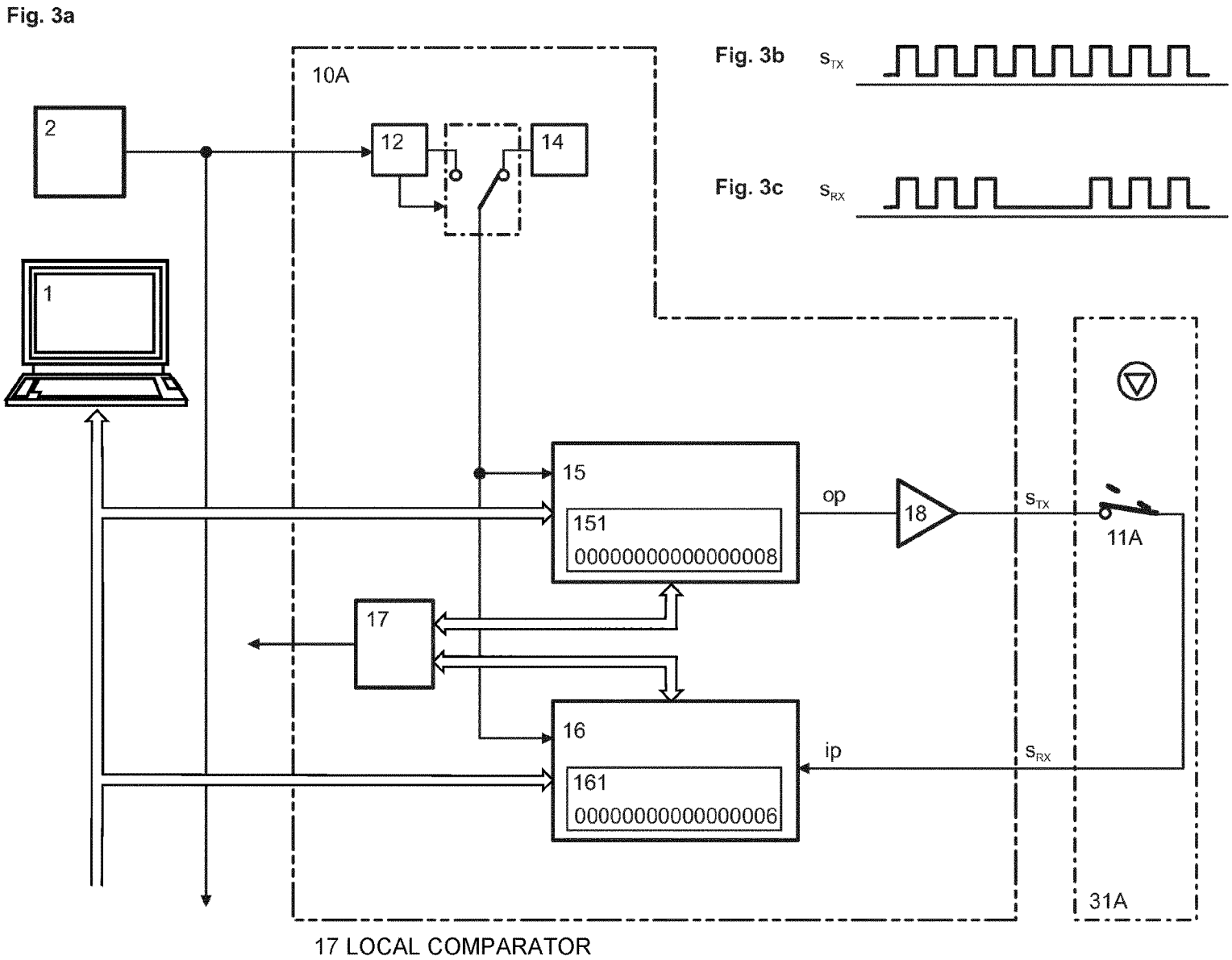
FIG. 3*a* illustrates the first monitoring unit of FIG. 2*a*, having the first monitoring module 15, which transmits a monitoring signal $s_{TX}$ via the switching contact 11A to a second processor-controlled monitoring module 16.

FIG. 3*a* illustrates the first monitoring unit of FIG. 2*a*, having the first monitoring module 15, which transmits a monitoring signal $s_{TX}$ from the output port op via the switching contact 11*a* to the input port ip of a second processor-controlled monitoring module 16. The two monitoring modules 15, 16 are powered by the battery 14. In the first monitoring module 15, the number of pulses sent is recorded in the register 151. In the second monitoring module 16, the number of the received pulses is recorded in a register 161.

FIG. 3*b* illustrates the monitoring signal $s_{TX}$ from FIG. 3*a*, as a pulse sequence having a duty cycle of 50% before the transmission via the switching contact 11A.

FIG. 3*c* illustrates the monitoring signal $s_{RX}$ from FIG. 3*b* after the transmission via the switching contact 11A, which has opened during the transmission of two pulses that were thus not recorded in the register 161 of the second monitoring module 16. Comparing the contents of the two registers 151, 161 makes it possible to establish the state change of the switching contact 11A. The comparison of the content of the registers 151, 161 can be performed in one of the monitoring modules 15, 16, in a local comparator 17, or centrally in the safeguard unit 1, which reads out all of the register contents from the monitoring units 10A, 10B.

Figure 4A:
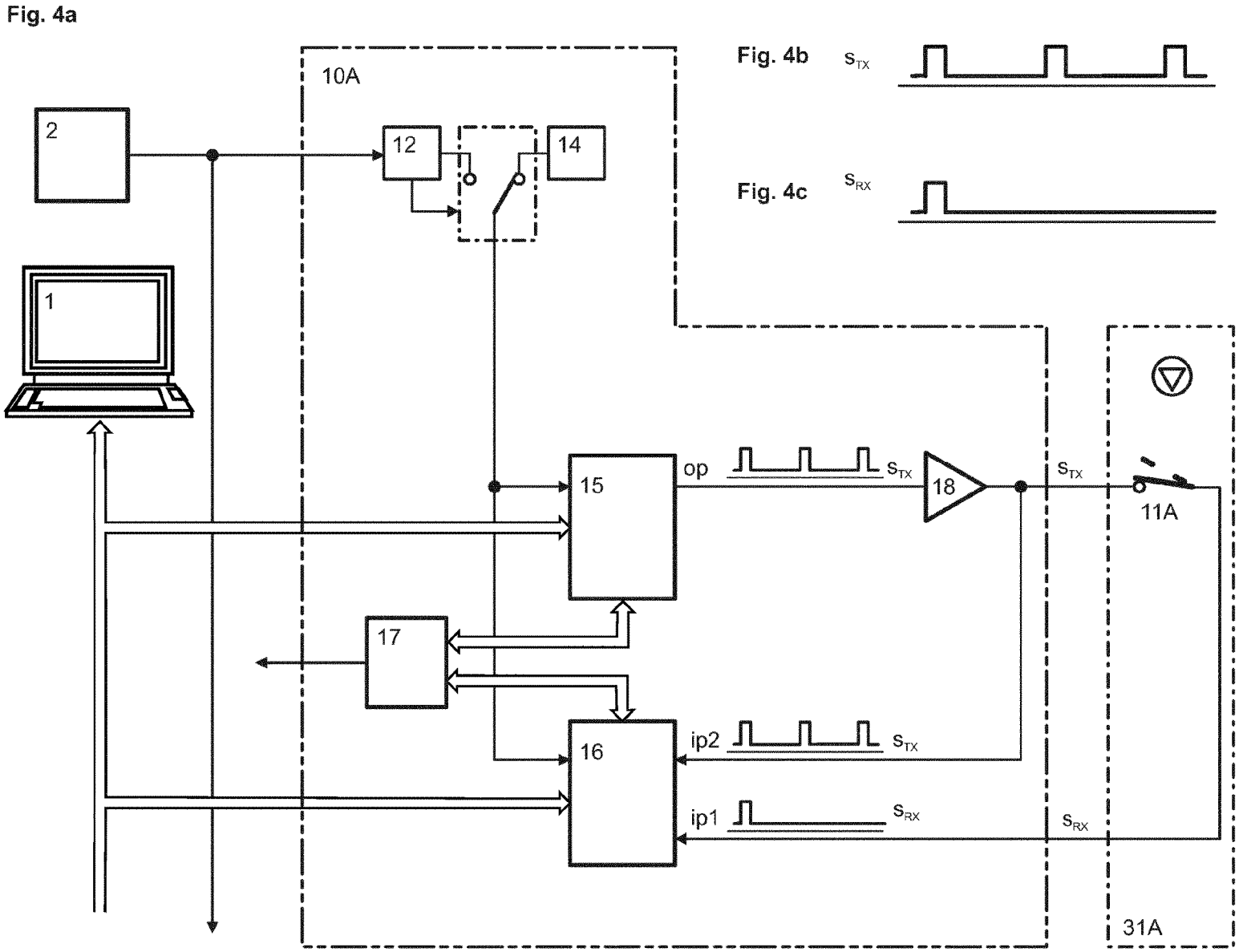
FIG. 4*a* illustrates the first monitoring unit from FIG. 3*a*, with the first monitoring module 15, the output port op thereof which is connected on the one side to a first input port ip1 of the second monitoring module 16 via the switching contact 11A and on the other side directly to a second input port ip2 of the second monitoring module 16.

FIG. 4*a* illustrates the first monitoring unit 10A from FIG. 3*a*, with the first monitoring module 15, the output port op thereof which is connected on the one side to a first input port ip1 of the second monitoring module 16 via the switching contact 11A and on the other side directly to a second input port ip2 of the second monitoring module 16.

The pulses transmitted directly to the second input port ip2 can be used as reference signals or as wake-up signals. With use as a reference signal, changes in the monitoring signal $s_{RX}$ that is transmitted via the switching contact 11A but has not, in this case, been filtered yet can be recognized immediately.

The monitoring signal $s_{TX}$ arriving at the input port ip2 may also, however be used as a wake-up signal, after the arrival of which the second monitoring module 16 is, in each case, moved from the sleep mode to the operating mode. So that the pulses transmitted via the switching contact 11A can be detected, the pulse width must be greater than the wake-up time of the second monitoring module 16 of, for example, 1 μs. For example, a pulse width of 25 μs—which makes it possible to safely recognize the incoming pulses—is selected.

A wake-up signal may also be generated internally in the monitoring modules 15, 16 and synchronized with the monitoring signal $s_{TX}$. As shown by the waveform wd in FIG. 7, a timer—for example, the watchdog 156—can count the cycle duration of the monitoring signal $s_{TX}$ and move the relevant monitoring module 15 or 16 from the sleep mode to the operating mode when the maximum counter state is reached, so that the first monitoring module 15 can, for example, send out one pulse and the second monitoring module 16 can receive this pulse.

FIG. 4*b* illustrates the monitoring signal $s_{TX}$ from FIG. 4*b* that is emitted at the output port op of the first monitoring module 15.

FIG. 4*c* illustrates the monitoring signal $s_{RX}$ from FIG. 4A arriving at the first input port ip1 of the second monitoring module 16, which contains only the first pulse. The monitoring signal $s_{TX}$ supplied directly to the second input port ip2 may now wake up the second monitoring module 16, which, after the transition into the operating mode, establishes that the second and third pulses are missing. As mentioned, the monitoring signal $s_{TX}$ supplied to the second input port ip2 may also be used as a reference signal.

Figure 5A:
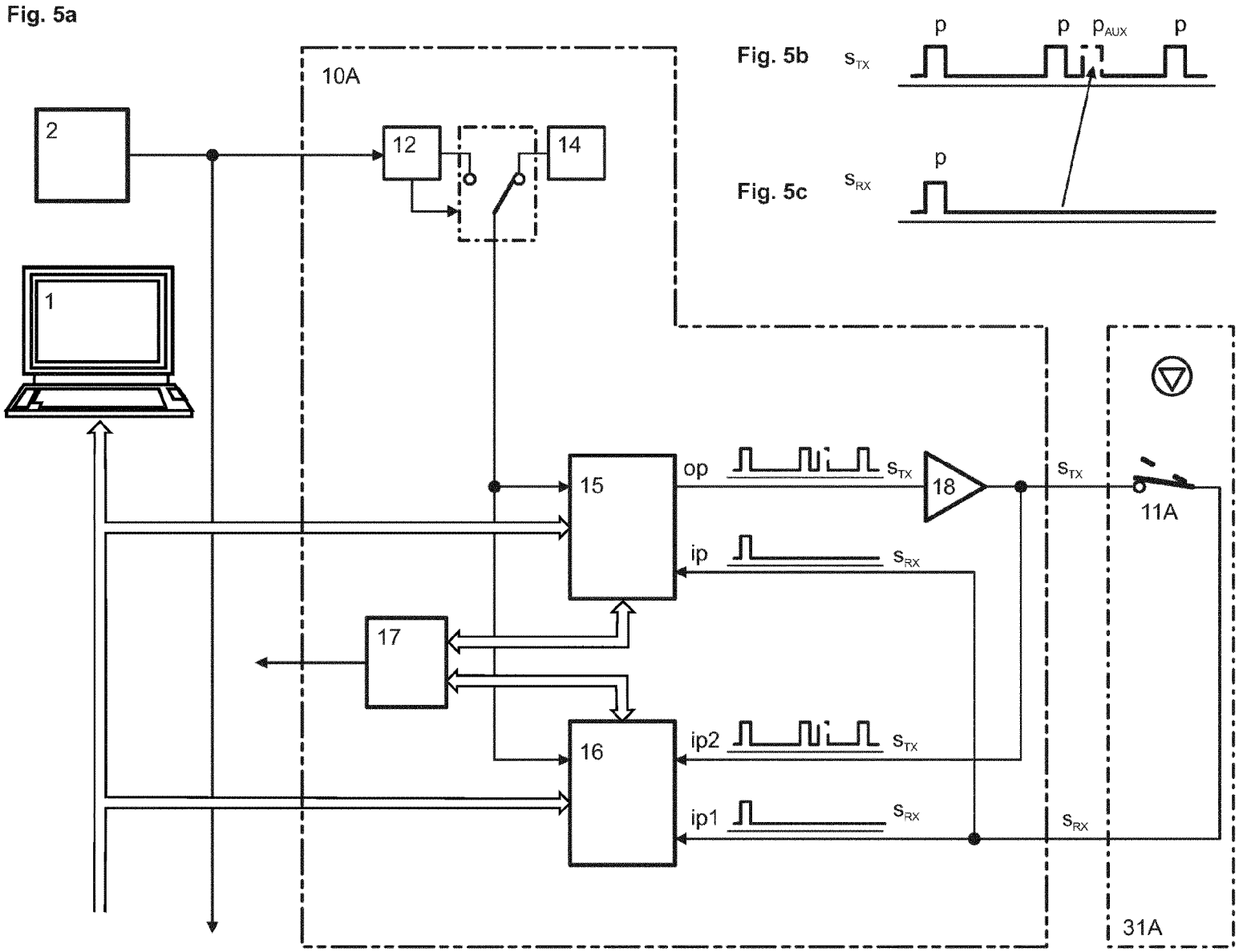
FIG. 5*a* illustrates the first monitoring unit from FIG. 4*a*, with which the monitoring signal $s_{TX}$ from FIG. 4*a* is additionally supplied via the switching contact 11A to an input port ip of the first monitoring module 15.

FIG. 5*a* illustrates the first monitoring unit from FIG. 4*a*, with which the monitoring signal $s_{TX}$ from FIG. 4*a* is additionally supplied via the switching contact 11A to an input port ip of the first monitoring module 15. The interruption of the switching contact 11A may thus alternatively or simultaneously be recognized in the first and second monitoring module 15, 16.

In the first monitoring module 15, the absence of a pulse is preferably used in order to change the test mode and intensify the inspection. Preferably, the pulse repetition frequency is at least briefly increased by a factor x that preferably lies in the range of 50 to 250. For example, a cycle duration in the range of 0.1 to 0.5 s is changed to a cycle duration in the range of 1 to 5 ms. With the increased pulse repetition frequency, the state of the switching contact 11A or a possible state change can successfully be quickly and precisely determined even if there are interference signals, which should be suppressed by means of the filter program FP. Delays that are caused by the filter program FP are then also reduced by the factor x.

FIG. 5*b* illustrates the monitoring signal $s_{TX}$ from FIG. 5*a*, as a pulse sequence having a duty cycle of approximately 7% before the transmission via the switching contact 11*a*, with an additionally-applied auxiliary pulse $p_{AUX}$, that is additionally emitted from the first monitoring module 15 after an expected pulse p of the transmitted monitoring signal $s_{RX}$ fails to appear. The auxiliary pulse $p_{AUX}$ illustrates symbolically that the monitoring signal is changed as needed $s_{TX}$, in order to be able to execute a quick inspection.

FIG. 5*c* illustrates the monitoring signal $s_{RX}$ from FIG. 5*b* after the transmission via the switching contact 11A, which has been opened after the arrival of a first pulse p.

Figure 6A:
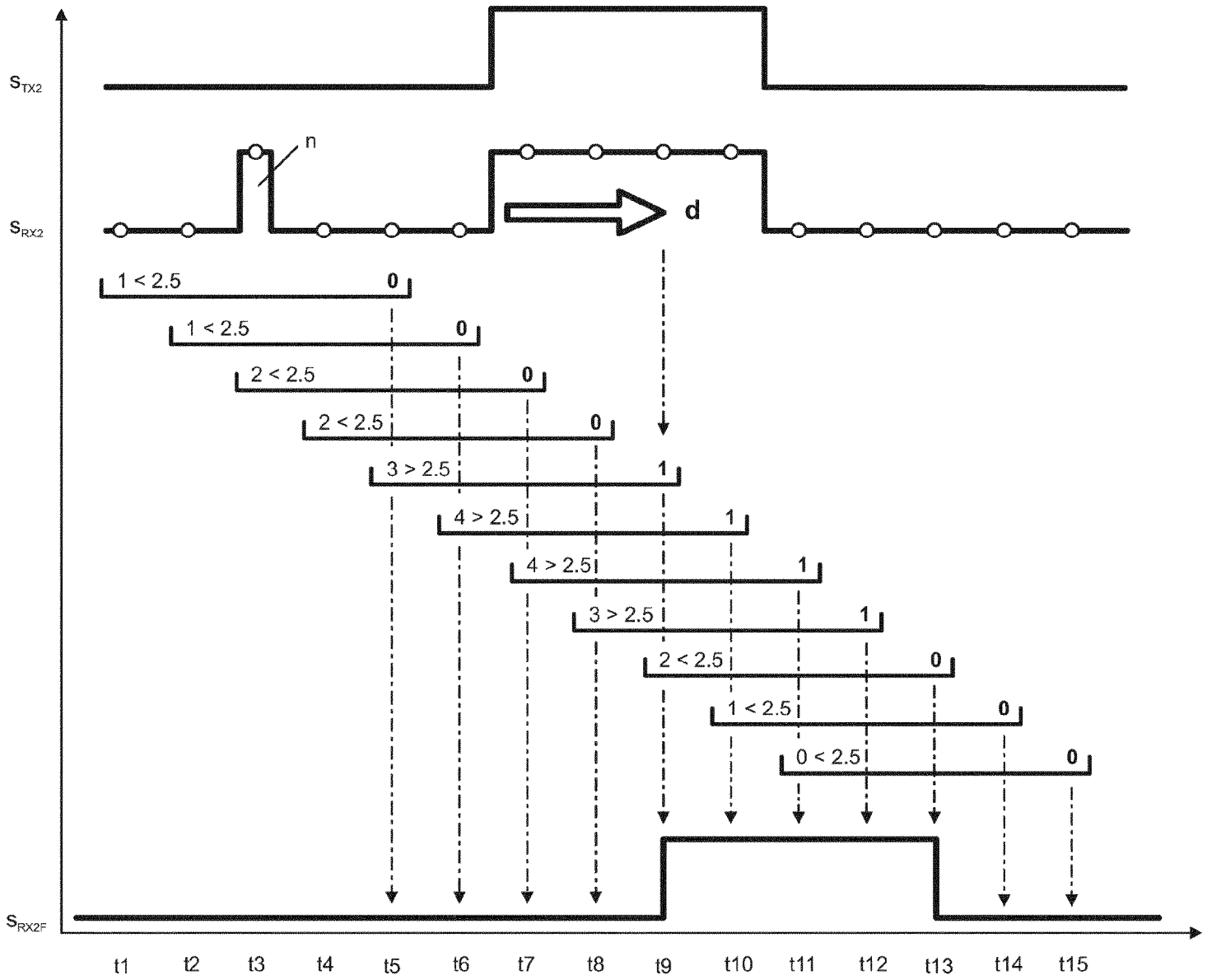
FIG. 6*a* illustrates a diagram with the transmitted monitoring signal $s_{TX2}$ from FIG. 2, with the transmitted monitoring signal $s_{RX2}$ from FIG. 2*d* that is provided with an interference pulse n, with schematically-illustrated filtering measures and with the filtered monitoring signal $s_{RXF}$, which has been shifted by more than two sampling cycles relative to the received monitoring signal $s_{RX2}$.

FIG. 6*a* illustrates a diagram with the sent monitoring signal $s_{TX2}$ from FIG. 2*c* and with the transmitted monitoring signal $s_{RX2}$ from FIG. 2*d* provided with an interference pulse n. Also illustrated schematically are filter measures and the filtered monitoring signal $s_{RXF}$, which is offset by more than two sampling cycles from the received monitoring signal $s_{RX2}$ and from which the interference pulse has been removed. The measurement is done at the output of the filter stage, which is implemented with hardware or software, with a significant delay.

The filter program FP, which is implemented in the second monitoring module 16, checks what value the majority of sample values within a filter interval have. The filter intervals each include the last five sample values. The filter program FP comprises, for example, a FIFO register into which the sample values can be read in in a stepwise manner. With each shift, the sum of the five values contained in the FIFO register is formed and checked for whether the sum is above or below the average value between the values where the FIFO register is completely filled or completely emptied, i.e., greater or smaller than 2.5. The values determined and the result are indicated for each filter interval. The transmission to the output of the filter takes place with the delay d only after the last sample value has arrived.

FIG. 6*a* shows that the filtered monitoring signal $s_{RXF}$ appears with a delay d—that corresponds approximately to twice the cycle duration of the sample signal—at the output of the filter stage. The sporadically-occurring interference pulse n has, however, been remedied.

Figure 6B:
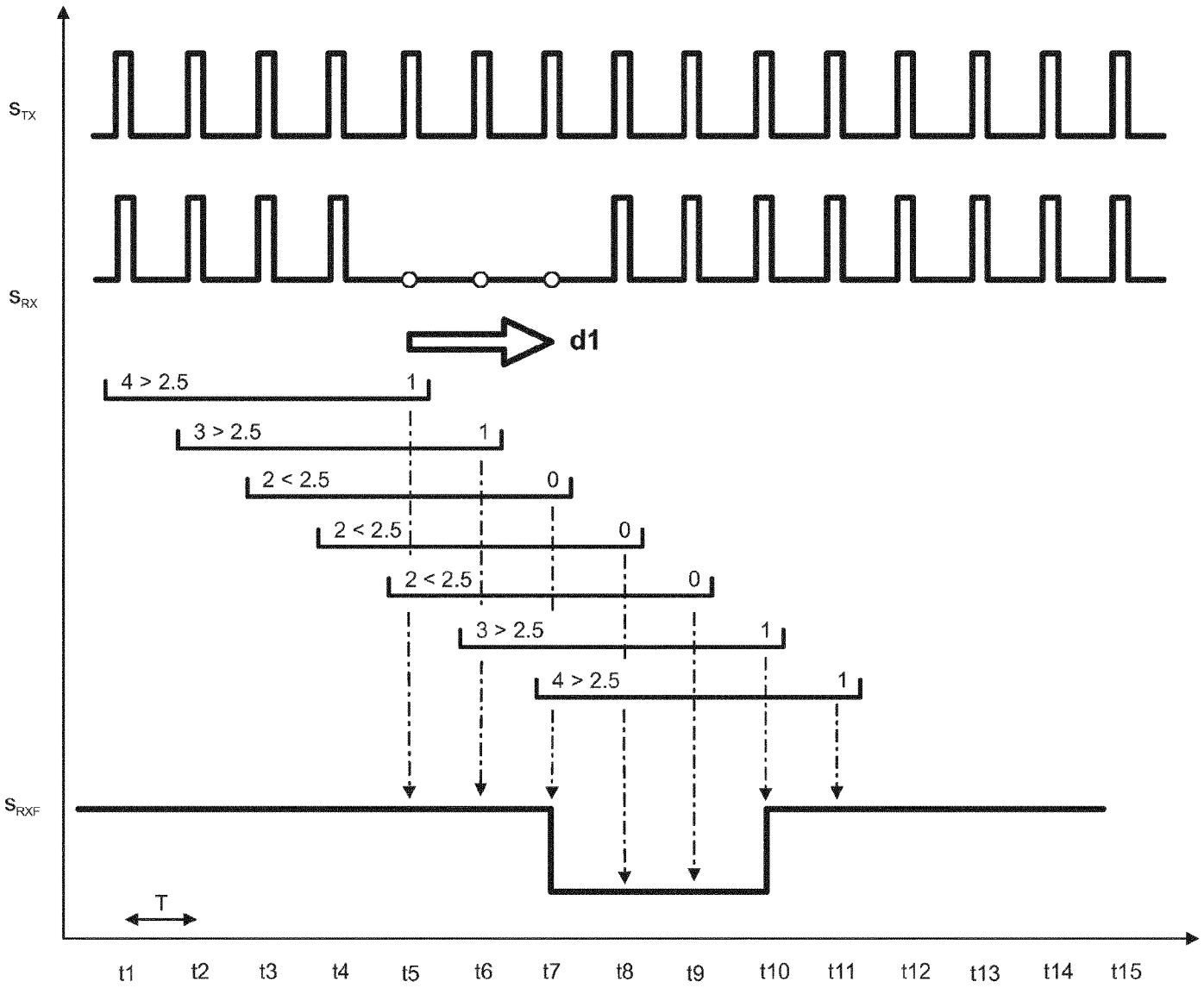
FIG. 6*b* illustrates a diagram with the sent monitoring signal $s_{TX}$ from FIG. 3*b*, with the transmitted monitoring signal $s_{RX}$ lacking three pulses, with schematically-illustrated filter measures, and with the filtered monitoring signal $s_{RXF}$ that has been shifted by two sampling cycles relative to the received monitoring signal $s_{RX}$.

FIG. 6*b* illustrates a diagram with the sent monitoring signal $s_{TX}$ from FIG. 3*b*, and the transmitted monitoring signal $s_{RX}$ that is missing three pulses. Also illustrated schematically are filter measures and the filtered monitoring signal $s_{RXF}$, which is likewise offset by approximately two sampling cycles from the received monitoring signal $s_{RX2}$ with a delay d1. The filter operation is performed as described with reference to FIG. 6*a*.

Figure 6C:
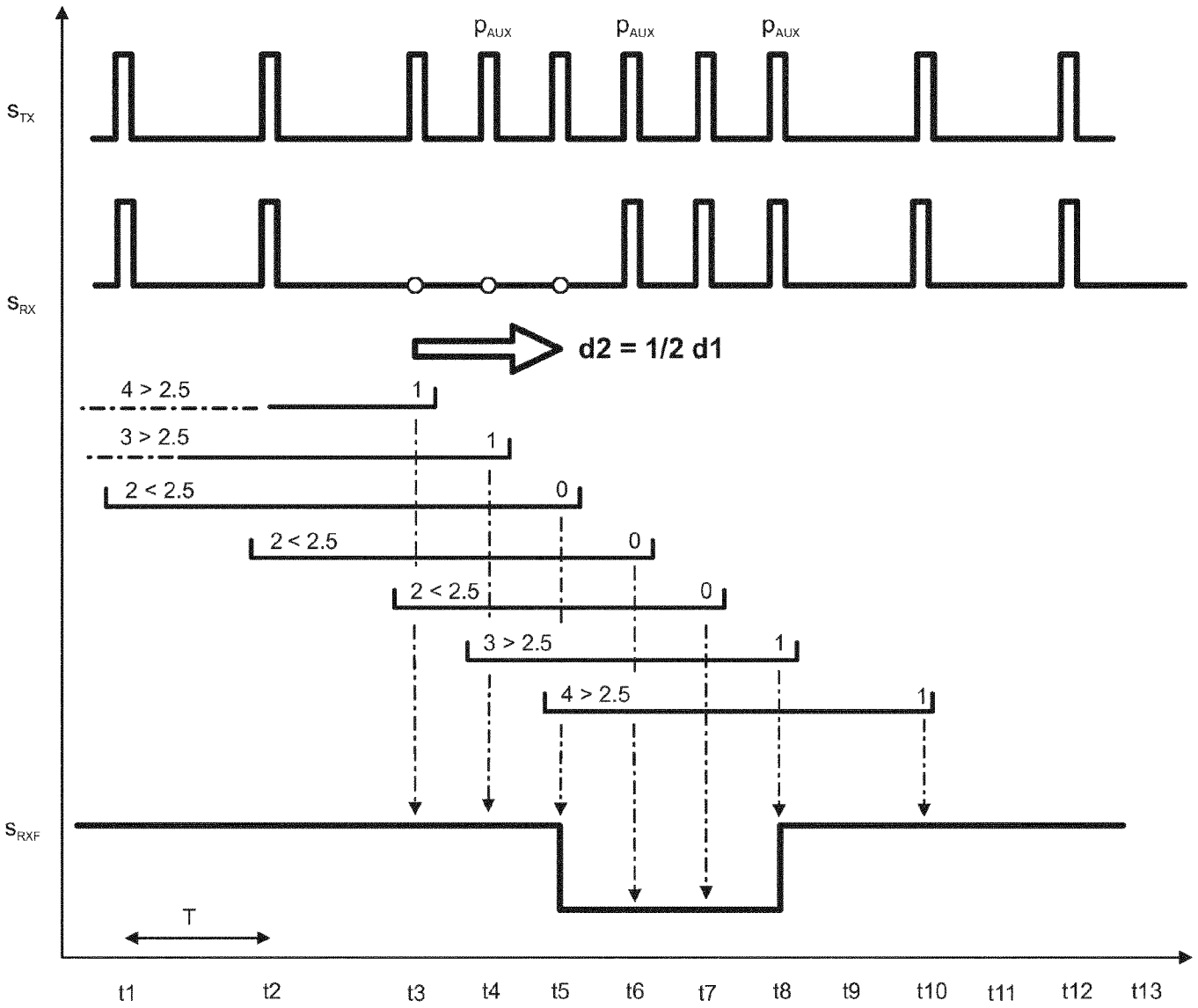
FIG. 6*c* illustrates a diagram with the sent monitoring signal $s_{TX}$ from FIG. 5*b* in which the pulse repetition frequency has been doubled after the failure of a pulse, with the transmitted monitoring signal $s_{RX}$ lacking three pulses, with schematically-illustrated filter measures, and with the filtered monitoring signal $s_{RXF}$ that has been shifted by two sampling cycles relative to the received monitoring signal $s_{RX}$ but has a halved cycle duration.

FIG. 6*c* illustrates a diagram with the sent monitoring signal $s_{TX}$ from FIG. 5*b*, and the transmitted monitoring signal $s_{RX}$ that is missing three pulses. When the monitoring signal $s_{TX}$ is sent, the pulse repetition frequency was doubled after the absence of a pulse was detected (see also the description of FIG. 5*a*). Also illustrated schematically are filter measures and the filtered monitoring signal $s_{RXF}$, which is offset by two sampling cycles from the received monitoring signal $s_{RX}$ with a delay d2, but has a halved cycle duration. The delay d2 has likewise been halved from the delay d1 from FIG. 6*b* (d2=½d1).

At the t3, it has been established in the first monitoring module 15 from FIG. 5*a* that an expected pulse has not arrived with the transmitted monitoring signal $s_{RX}$. After this event, the pulse repetition frequency has been doubled by the first monitoring module 15, and thus the pulse interval has been halved. The length of the filter intervals and the delay d can thus be reduced discretionarily, by increasing the pulse repetition frequency.

In a preferred embodiment, it is provided that after the absence of a pulse, for a short duration in the range of, for example, 1 to 10 seconds, the first monitoring module 15 sends out a burst or sequence of pulses having intervals reduced by the above-mentioned factor x, which preferably is in the range of 50 to 250.

Figure 7:
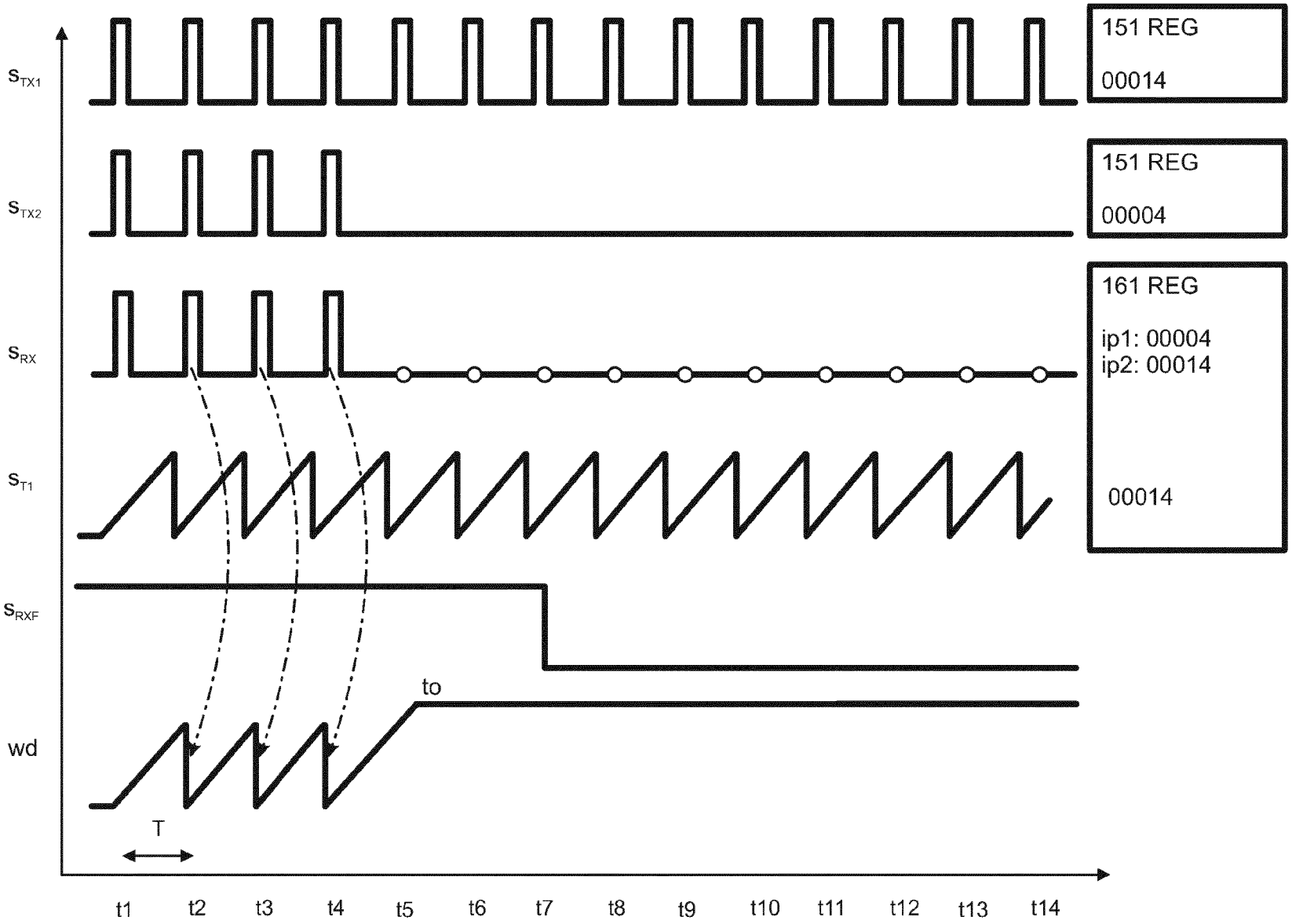
FIG. 7 illustrates a diagram with two waveforms of the monitoring signal $s_{TX1}$, $s_{TX2}$ to be transmitted, the waveform of the transmitted monitoring signal $s_{RX}$, the waveform at the output of a timer in the second monitoring module 16, and the received monitoring signal $s_{RXF}$ after the filtering.

FIG. 7 illustrates a diagram with two waveforms of the monitoring signal $s_{TX1}$, $s_{TX2}$ to be transmitted, and the waveform of the transmitted monitoring signal $s_{RX}$. Also illustrated are the waveform wd at the output of a timer in the second monitoring module 16 and the received monitoring signal $s_{RXF}$ after the filtering. The timer corresponds, for example, to the watchdog 156 of the first monitoring module 15.

FIG. 7 indicates that the change in the waveform of the transmitted monitoring signal $s_{RX}$ can have two different causes.

In the first case, there may be—at the time t5—a state change in the switching contact 11A, which is interrupted and does not pass the pulses of the first monitoring signal $s_{TX1}$ on to the input port ip1 of the second monitoring module 16.

In the second case, the monitoring signal $s_{TX2}$ is no longer generated in the first monitoring module 15, so that after the time t4, no more pulses can pass via the closed switching contact 11A to reach the input port ip1 of the second monitoring module 16. If the pulses of the monitoring signal $s_{TX2}$, with the circuit arrangements in FIGS. 4*a* and 5*a*, no longer reach the second input port ip2 of the second monitoring module 16, then same is no longer transferred from the sleep mode to the operating mode. The counter states for the sent and received pulses therefore remain constant or are frozen. If the counter states have been frozen with identical values, this indicates the closed state of the monitored switching contact 11A, 11B, although same may perhaps have been opened in the meantime.

The invention proposes two solutions to this problem, which are applied either alternatively or preferably in combination.

In the first solution variant, a wake-up signal $s_{T1}$ is generated by a timer 157 within the second monitoring module 16 (which preferably has the same modules as the first monitoring module 15). The wake-up signal $s_{T1}$ is synchronized with the monitoring signal $s_{TX}$ emitted from the first monitoring module 15, and has the same frequency, but has been shifted forward by a fraction of the cycle duration. With the falling edge of the wake-up signal $s_{T1}$, the second monitoring module 16 is in each case transferred from the sleep mode to the operating mode, in order to receive a pulse of the transmitted monitoring signal $s_{RX}$. As a result, the actual value of the pulses that actually arrived and the setpoint value of the expected pulses are recorded, such as is illustrated in FIG. 7. The difference between the 4 pulses that arrived and the 14 pulses that were expected indicates that a state change has occurred in the first monitoring module 15 or at the switching contact 11A.

If the pulses of the monitoring signal $s_{TX1}$, $s_{TX2}$ are also counted at the second input port ip2 of the second monitoring module 16, the state of the first monitoring module 15 can be determined. The counter states of the register 161 show that 14 pulses have been sent out from the first monitoring module, that 14 pulses were expected, and that four pulses were transmitted via the switching contact 11A. The concordance of 14 emitted and 14 expected pulses shows that the first monitoring module 15 is functioning properly. The difference between the 14 sent and expected pulses on the one hand and the four received pulses on the other hand indicates, however, that the switching contact 11A has been opened. The received and filtered monitoring signal $s_{RXF}$ shows the state change of the switching contact 11A.

In the second solution variant, the counter states of the registers 151, 161 are read out by the safeguard unit 1 after the end of the power failure from all of the monitoring units 10A, 10B, and compared against one another. The comparison shows whether the register states are frozen at one of the monitoring units 10A, 10B and an error has occurred. If the register states in each of the monitoring units 10A, 10B are identical but there are differences between the monitoring units 10A, 10B, then a functional error can be deduced.

When the counter states are processed, tolerances are preferably provided, with which deviations of counter states that are insufficient for indicating a malfunction or a state change in the monitoring sensors or switching contacts 11A, 11B are neglected.

FIG. 2*a* shows that the monitoring modules 15, 16 preferably have a so-called watchdog 156 that is configured as a timer or counter and advantageously can be used to monitor the switching contact 11A or 11B or even the first monitoring module 15. With the circuit arrangements in FIGS. 4*a* and 5*a*, the monitoring signal $s_{TX}$ with the pulse sequences (see, for example, FIG. 7 with the waveforms $s_{TX1}$ and $s_{TX2}$) is supplied to the second input port ip2 directly/not via the switching contact 11A/11B of the second monitoring module 16. The monitoring signal $s_{RX}$ transmitted via the switching contact 11A/11B is supplied to the first input ip1 of the second monitoring module 16. The absence of a pulse of the monitoring signals $s_{TX1}$ or $s_{TX2}$ or $s_{RX}$ supplied to the first and/or second input port ip1/ip2 can now be monitored with reference in each case to a watchdog 156, for which a timeout or count value that is never achieved with regular arrival of all of the pulses is established. FIG. 7 illustrates the monitoring of the monitoring signal $s_{RX}$ transmitted via the switching contact 11A/11B, the pulses of which each reset the watchdog 156 on the rising edge, so that the watchdog cannot increment to the timeout to. At the time t5, however, pulses are no longer transmitted via the switching contact 11A/11B, so that the watchdog 156 is not reset and increments to the timeout, triggering an alarm or signaling a state change. In the same manner, the monitoring signal $s_{TX2}$ illustrated in FIG. 7 would cause a timeout at a second watchdog at the time t5.

It is preferably provided that the filtered input signal $s_{RXF}$ is supplied to the watchdog 156. This prevents the watchdog 156 from being reset by interference pulses and being unable to increment to the timeout in the absence of a pulse of the monitoring signal $s_{RX}$.

The state changes signaled by the watchdog 156 are, for example, stored in the register 151 and transmitted to the safeguard unit 1 with the other state data after the power failure has ended. Preferably, the waveform of the output signal of the watchdog 156 is stored and analyzed, for example, in order to establish the duration of the interruptions of the switching contact 11A/11B. Normally, it is provided that the elevator system 3 is prevented from being started up already after the arrival of a timeout for a pulse. Alternatively, it may be established that the timeout must be changed for a certain number of pulses before the elevator system 3 is prevented from being started up. This distinguishes, for example, whether an irregularity in the circuit or a door opening has occurred.

Figure 8:
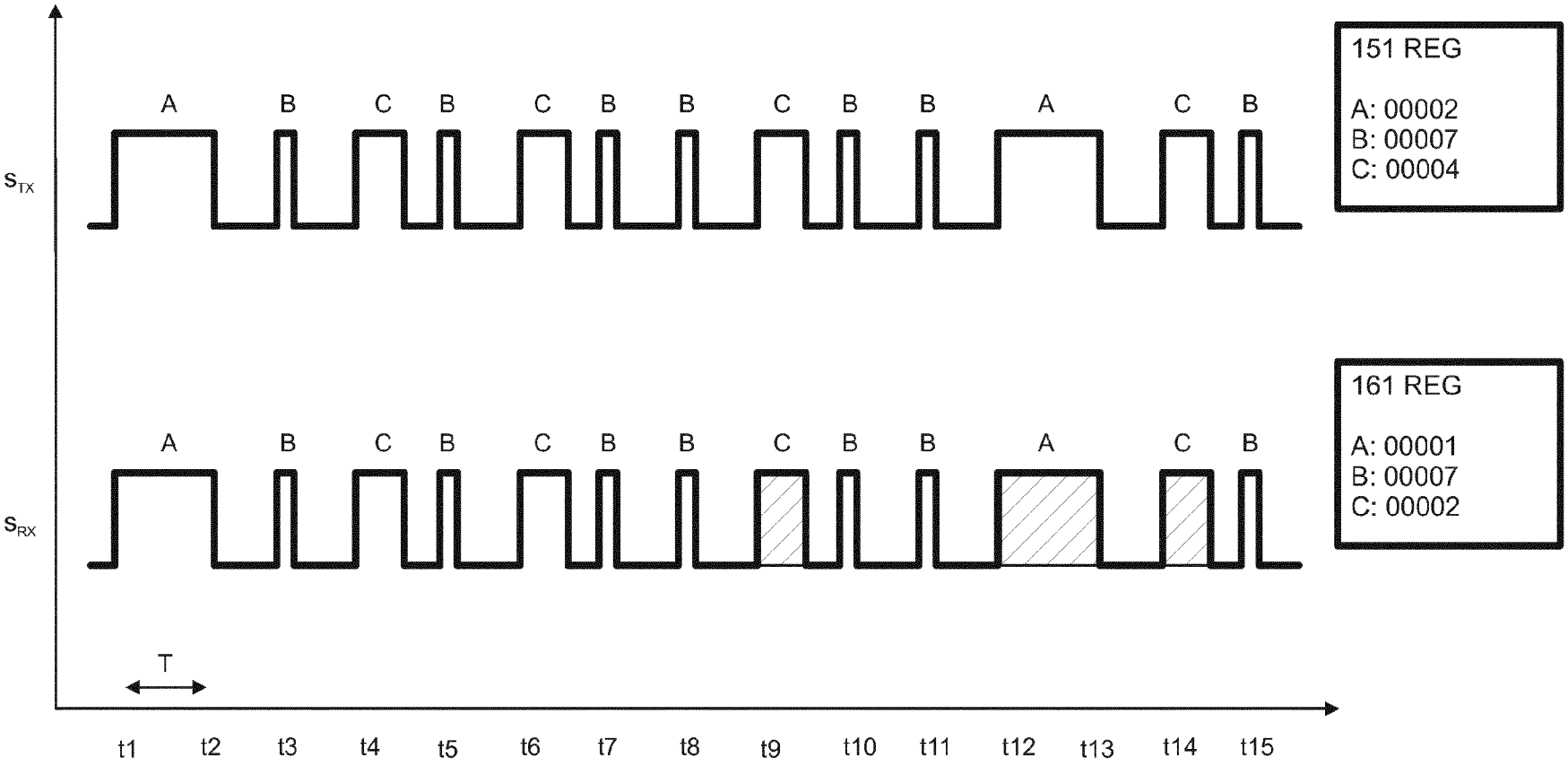
FIG. 8 illustrates a diagram with a waveform of a monitoring signal $s_{TX}$ generated in the first monitoring module 15, with three different variants A, B, C of pulses that have different pulse widths, and the waveform of the monitoring signal $s_{RX}$ that is received in the second monitoring module 16, in which three pulses (shown with hatching) of the variants A and C are not present or are not correct.

FIG. 8 illustrates a diagram with a waveform of a monitoring signal $s_{TX}$ generated in the first monitoring module 15, with three different variants A, B, C of pulses that have different pulse widths. Also illustrated is the waveform for the monitoring signal $s_{RX}$ received in the second monitoring module 16, in which three pulses of the variants A and C are not present or are not correct. The number of pulses emitted is recorded in the register 151 of the first monitoring module 15 for each of the variants A, B, and C. The number of the received pulses for each of the variants A, B, and C is likewise recorded in the register 161 of the second monitoring module 16.

The pulses can be lost or affected over the entire transmission path. Analyzing the changes makes it possible to deduce the type of interference. The electronic elements of the monitoring modules 15, 16 and thus easily be inspected by means of the variation in the pulses. The inspection may be carried out sporadically or also in a regular pattern by the safeguard unit 1, or autonomously by the monitoring modules 10A, 10B.

Alternatively, the pulse amplitudes, pulse intervals, or the pulse repetition frequency may also be selectively changed.

After a power failure has ended or a simulation of a power failure has ended, the safeguard unit 1 reads out the recorded state data from all of the connected monitoring units 10A, 10B and the monitoring modules 15, 16 provided therein, and carries out an analysis.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for safely controlling an elevator system, the elevator system including a drive unit for moving an elevator car in an elevator shaft and being controlled in a safe manner by a control device, comprising the steps of:

in a normal mode of operation of the elevator system, moving the elevator car to at least two doors providing access to the elevator shaft from outside the elevator shaft, the doors being controlled by the control device, a door lock being associated with one of the doors by which the associated door can be unlocked and opened even in the case of a failure of electrical power to the elevator system;

preventing the elevator car from moving or allowing movement only to a limited extent if an individual is in the elevator shaft;

providing a monitoring unit and a monitoring sensor associated with the associated door for detecting state changes including unlocking or opening of the associated door;

wherein the monitoring unit is equipped with a battery and is switched to an autonomous mode when the elevator system is entirely or partially disabled;

wherein the monitoring unit is connected to the monitoring sensor and monitors a state of the monitoring sensor at least during the autonomous mode, and records state data corresponding to the state changes;

wherein the monitoring unit is connected to a safeguard unit that reads the recorded state data from the monitoring unit, the safeguard unit evaluating the state data and prevents the elevator system from being put into the normal mode of operation if a change in the state of the associated door has been detected;

wherein the monitoring sensor is a switching contact coupled to the door lock and a monitoring signal is transmitted from an output to an input of the monitoring unit through the switching contact, and the transmitted monitoring signal is monitored with respect to the state changes which occur upon actuation of the door lock; and wherein the monitoring signal is a sequence of pulses.

2. The method according to claim 1 characterized wherein the monitoring signal is a sequence of identical pulses, or a sequence of different pulses having an established setpoint form.

3. The method according to claim 1 wherein:

the monitoring unit has a first processor-controlled monitoring module, operating the monitoring module to emit the monitoring signal at an output port to the switching contact and receive the monitoring signal from the switching contact at an input port; or the monitoring unit has first and second processor-controlled monitoring modules, operating the first monitoring module to emit the monitoring signal at an output port to the switching contact and operating the second monitoring module to receive the monitoring signal from the switching contact at an input port; or the monitoring unit has first and second processor-controlled monitoring modules, operating the first monitoring module to emit the monitoring signal at an output port to the switching contact and operating the first and second monitoring modules each to receive the monitoring signal at a respective input port.

4. The method according to claim 3 wherein:

the monitoring signal emitted from the output port of the first monitoring module is supplied to a first input port of the second monitoring module through the switching contact and supplied directly to a second input port of the second monitoring module; or the monitoring signal emitted from the output port of the first monitoring module is supplied to a first input port of the second monitoring module and to an input port of the first monitoring module through the switching contact, and supplied directly to a second input port of the second monitoring module.

5. The method according to claim 3 including transmitting the pulses in time intervals within which at least one of the first and second monitoring modules is transferred to a sleep mode when a first event occurs and to an operating mode when a second event occurs, wherein the first event is an end of the recording of the state data corresponding to the state changes in the transmitted monitoring signal or expiration of a timer, and the second event is arrival of one of the transmitted pulses of the monitoring signal or the expiration of the timer.

6. The method according to claim 5 wherein the safeguard unit or at least one of the first and second monitoring modules compares the monitoring signal transmitted through the switching contact with either the monitoring signal not transmitted through the switching contact or a setpoint form of the transmitted monitoring signal, and records deviations as well as a corresponding functional error in one of the first and second monitoring modules.

7. The method according to claim 3 wherein at least one of the first and second monitoring modules has at least one register for storing the state data, a number of the pulses sent and a number of the pulses received are stored in the at least one register, and a difference between the stored number of the pulses sent and the stored number of the pulses received is formed in at least one of the first and second monitoring modules or in the safeguard unit and represents a state change that may have occurred.

8. The method according to claim 3 wherein at least one of the first and second monitoring modules includes a filter program that filters the received monitoring signal and functions as a low-pass filter or median filter to establish whether a number of the monitoring signal pulses that have arrived is greater or smaller than half a number of expected or sent ones of the monitoring signal pulses.

9. The method according to claim 1 including supplying the monitoring signal transmitted through the switching contact to an input of a watchdog timer that is reset with each arrival of the pulses of the monitoring signal, and that increments up to a timeout and signals a state change when one of the pulses of the monitoring signal is missing.

10. The method according to claim 3 including passing the monitoring signal emitted from the output port of the first monitoring module is passed through the switching contact to the input port of the first monitoring module and is monitored, and wherein the first monitoring module, after an absence of an expected pulse, emits a plurality of pulses with a pulse repetition frequency that is increased by the predetermined factor with respect to a pulse frequency of the monitoring signal, the plurality of pulses being supplied to the first input port of the second monitoring module through the switching contact as well as directly to the second input port of the second monitoring module.

11. The method according to claim 3 including, during the autonomous mode of the monitoring unit, resetting the first and second monitoring modules and deleting the stored state data in response to at least one of a voltage from the battery falls below a threshold value and a brownout is occurring in one of the first and second monitoring modules.

12. The method according to claim 1 wherein the safeguard unit reads the recorded state data from the monitoring unit and performs at least one of:

checks a functionality of monitoring unit;

establishes any state changes or malfunctions that have occurred in the monitoring unit;

determines deviations in numbers of the transmitted and received pulses recorded in the monitoring unit; and if there is a missing functionality of the monitoring unit, or if a state change has occurred in the monitoring unit, or if there is a deviation in the numbers of the transmitted and received pulses recorded in the monitoring unit, the safeguard unit prevents the elevator system from being transferred back to the normal mode of operation.

13. An elevator system having a drive unit connected to an elevator car located in an elevator shaft and controlled by a control device, wherein in a normal mode of operation, the elevator car can be moved to at least two doors providing access to the elevator shaft from outside the elevator shaft, the doors being controlled by the control device, a door lock being associated with at least one of the doors by which door lock the associated door can be unlocked and opened even in the case of a power failure, and wherein the elevator car is prevented from moving or enabled to move only to a limited extent if an individual is in the elevator shaft, comprising:

a monitoring unit and a monitoring sensor associated with at least one of the doors for detecting state changes such as unlocking or opening of the at least one door;

wherein the monitoring unit is equipped with a battery and can be switched to an autonomous mode when the elevator system is entirely or partially disabled;

wherein the monitoring unit is connected to and monitors the monitoring sensor and records the state changes at least during the autonomous mode;

wherein the monitoring unit is connected to a safeguard unit for assessing the state changes in the at least one door and preventing the elevator system from being placed in the normal mode of operation;

wherein the monitoring sensor is a switching contact coupled to the door lock associated with the at least one door, a monitoring signal being transmitted from an output to an input of the monitoring unit, and the transmitted monitoring signal being monitored with respect to the state changes which occur upon actuation of the door lock associated with the at least one door; and wherein the monitoring signal is a sequence of pulses.

14. The elevator system according to claim 13 wherein:

the monitoring unit has a first processor-controlled monitoring module having an output port from which the monitoring signal is transmitted through the switching contact to an input port of the first monitoring module; or the monitoring unit has the first monitoring module having the output port from which the monitoring signal is transmitted through the switching contact to an input port of a second monitoring module.

15. The elevator system according to claim 14 wherein:

the monitoring signal from the output port of the first monitoring module is transmitted to a first input port of the second monitoring module through the switching contact and is directly transmitted to a second input port of the second monitoring module; or the monitoring signal from the output port of the first monitoring module is transmitted to the first input port of the second monitoring module and to an input port of the first monitoring module through the switching contact, and is transmitted directly to the second input port of the second monitoring module.

* * * * *